US009827480B2

(12) United States Patent
Mitchell, Jr. et al.

(10) Patent No.: US 9,827,480 B2
(45) Date of Patent: Nov. 28, 2017

(54) STRAP LATCHING DEVICE

(71) Applicants: Bruce James Mitchell, Jr., Dexter, MI (US); Joseph Albert Simon, Ann Arbor, MI (US)

(72) Inventors: Bruce James Mitchell, Jr., Dexter, MI (US); Joseph Albert Simon, Ann Arbor, MI (US)

(73) Assignee: Home Team Sports, LLC, Ann Arbor, MI (US)

( * ) Notice: Subject to any disclaimer, the term of this patent is extended or adjusted under 35 U.S.C. 154(b) by 254 days.

(21) Appl. No.: 14/867,854

(22) Filed: Sep. 28, 2015

(65) Prior Publication Data

US 2016/0051013 A1 Feb. 25, 2016

Related U.S. Application Data

(63) Continuation-in-part of application No. 14/212,830, filed on Mar. 14, 2014, now Pat. No. 9,144,270.

(51) Int. Cl.

| | |
|---|---|
| ***A44B 11/00*** | (2006.01) |
| ***A44B 17/00*** | (2006.01) |
| ***A63B 71/10*** | (2006.01) |
| ***A42B 3/08*** | (2006.01) |
| *A44B 11/26* | (2006.01) |

(52) U.S. Cl.

CPC ..... *A63B 71/10* (2013.01); *A42B 3/08* (2013.01); *A44B 11/005* (2013.01); *A44B 11/266* (2013.01); *Y10T 24/2192* (2015.01); *Y10T 24/44376* (2015.01)

(58) Field of Classification Search

CPC ... A44B 11/16; A44B 11/065; A44B 11/2519; A44B 11/006; A42B 3/08; A42B 3/00

See application file for complete search history.

(56) References Cited

U.S. PATENT DOCUMENTS

| | | | | |
|---|---|---|---|---|
| 1,871,378 | A * | 8/1932 | Kimbell | A44B 17/0023 24/324 |
| 3,237,257 | A * | 3/1966 | Forsberg | A44B 11/006 24/324 |
| 4,217,681 | A * | 8/1980 | Grohoski | A44C 5/14 224/164 |
| D486,093 | S * | 2/2004 | Tobergte | D11/218 |
| 7,475,453 | B2 * | 1/2009 | Drake | A44B 11/04 24/324 |
| D628,515 | S * | 12/2010 | Schiebl | D11/218 |
| 7,900,279 | B2 | 3/2011 | Kraemer et al. | |
| 8,056,151 | B2 * | 11/2011 | Bologna | A42B 3/08 2/421 |
| 8,813,317 | B2 | 8/2014 | Mitchell et al. | |
| 9,629,410 | B2 * | 4/2017 | Perreault | A42B 3/08 |

(Continued)

*Primary Examiner* — Robert J Sandy
*Assistant Examiner* — Jason W San
(74) *Attorney, Agent, or Firm* — Vivacqua Law, PLLC; Raymond J. Vivacqua

(57) ABSTRACT

A latching device configured to secure a first piece of material to a second piece of material. For example, the first piece of material is a boat tarp and the second piece of material is a boat hull. The latching device includes a locking buckle and clasp assembly. The locking buckle has a main body portion and a release mechanism. The release mechanism has locking pawls with claw members. The locking pawls engage the clasp assembly to releasably retain the locking buckle on the clasp assembly.

12 Claims, 5 Drawing Sheets

(56) References Cited

U.S. PATENT DOCUMENTS

| | | | | |
|---|---|---|---|---|
| 2007/0044283 | A1* | 3/2007 | Longley | A44B 11/2515 24/633 |
| 2007/0193006 | A1* | 8/2007 | Kitano | A44B 17/0011 24/323 |
| 2012/0144628 | A1* | 6/2012 | Mitchell, Jr. | A42B 3/08 24/191 |
| 2012/0246895 | A1* | 10/2012 | Lee | B60P 7/083 24/68 E |

* cited by examiner

STRAP LATCHING DEVICE

CROSS-REFERENCE TO RELATED APPLICATIONS

This application is a Continuation In Part of U.S. patent application Ser. No. 14/212,830 filed Mar. 14, 2014. The disclosure of the above referenced application is incorporated herein by reference.

FIELD

The present invention relates to athletic equipment and other equipment or devices that utilize straps or bands to retain equipment or devices on an athlete and more particularly to devices for realeasably attaching straps and other members to the equipment to retain the equipment on an athlete.

BACKGROUND

Sports helmets, particularly football helmets, have undergone substantial changes over the last 50 years. Helmets are retained by a chinstrap laced through buckles that snap onto the helmet. The buckles integrate ordinary snaps similar to snaps on a jacket. The chinstrap fixes the helmet in position and is designed to retain the helmet on a player's head. Current chinstrap buckles become unsnapped during game play on impact or by other game circumstances, resulting in helmets coming off during play. As sports such as football have become higher velocity contests, helmets are coming off at increasing and alarming rates causing potential danger to participants.

Youth players often lack sufficient strength to properly snap current buckles. This results in incomplete engagement and uncertain stability and retention. Youth players are also often unsure when current buckles are actually properly engaged as a definitive "snap" is often unattainable.

SUMMARY

The present invention is a latching device for securing a strap to a piece of sports equipment or other wearable equipment. The latching device includes a buckle and clasp assembly. The buckle has a main body portion and a release mechanism. The release mechanism has locking pawls with claw members. The main body portion has a first slot and a second slot. The first and second slots each having a plurality of teeth shaped members that are configured to secure the strap to the buckle.

The clasp assembly is attached to the piece of sports equipment. The clasp assembly has cylindrical receiving member which is attached to a piece of sports equipment. The cylindrical receiving member has a first surface and a second surface. The first surface has an open end with an annular rim that is formed on the interior shoulder of the cylindrical receiving member of the clasp assembly and a threaded shaft extending from a bottom surface of the clasp assembly. The claw members of the locking pawls are releasably received in the first open end of the cylindrical receiving member to releasably engage the buckle with the clasp assembly.

In another embodiment of the present invention, a latching device for releasably securing a strap to a piece of sports equipment is provided. The latching device includes a main body, a release mechanism and a clasp assembly.

In yet another embodiment of the present invention, the main body member has a pair of slots for receiving and releasibly securing the strap to the main body member, a central cavity and a side cavity.

In yet another embodiment of the present invention, the release mechanism has a pair of opposing buttons, a pair of locking pawls and a first biasing member. One of the pair of locking pawls is fixedly attached to one of the pair of opposing buttons and the other of the pair of locking pawls is fixedly attached to the other of the pair of opposing buttons. The pair of locking pawls extend through the side cavity of the main body member and extend into the central cavity of the main body member. The first biasing member is disposed between the opposing buttons urging the buttons away from each other.

In yet another embodiment of the present invention, The clasp is attachable to the piece of sports equipment, the clasp has a cylindrical body sized for receipt within the central cavity of the main body member and has a central cavity defined by an inner surface. An annular rim extends inward from the inner surface of the central cavity of the cylindrical body.

In still another embodiment of the present invention, the locking pawls are configured to engage the annular rim of the central cavity of the clasp.

In another embodiment of the present invention, the latching device has a main body member having a central cavity and a side cavity and a first attachment member attached at an end to a bottom surface of the main body. A second attachment member engagable with the first attachment member to secure the first material to the main body is provided. A release mechanism has a pair of opposing buttons, a pair of locking pawls and a first biasing member. One of the pair of locking pawls is fixedly attached to one of the pair of opposing buttons and the other of the pair of locking pawls is fixedly attached to the other of the pair of opposing buttons. The pair of locking pawls extend through the side cavity of the main body member and extend into the central cavity of the main body member. The first biasing member is disposed between the opposing buttons urging the buttons away from each other. A clasp attachable to the second material and having a cylindrical body sized for receipt within the central cavity of the main body member and having a central cavity defined by an inner surface. An annular rim extends inward from the inner surface of the central cavity of the cylindrical body. The locking pawls are configured to engage the annular rim of the central cavity of the clasp.

In another embodiment of the present invention, the first attachment member is a threaded shaft attached at an end to the bottom surface of the main body.

In another embodiment of the present invention, the second attachment member is an annular ring having a threaded inner surface that engages with the threaded shaft attached at an end to the bottom surface of the main body.

The above features and advantages and other features and advantages of the present invention are readily apparent from the following detailed description of the best modes for carrying out the invention when taken in connection with the accompanying drawings wherein like reference numbers refer to the same component, element or feature.

DRAWINGS

The drawings described herein are for illustration purposes only and are not intended to limit the scope of the present disclosure in any way.

DETAILED DESCRIPTION

Figure 1:
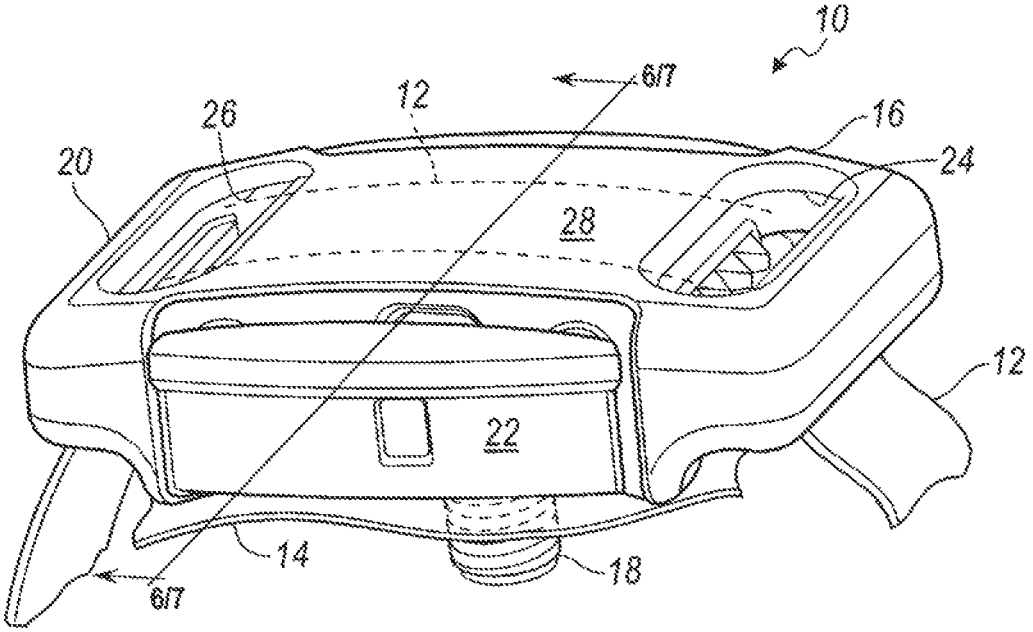
FIG. 1 is a perspective view of a strap latching device in accordance with the present invention.
Figure 2:
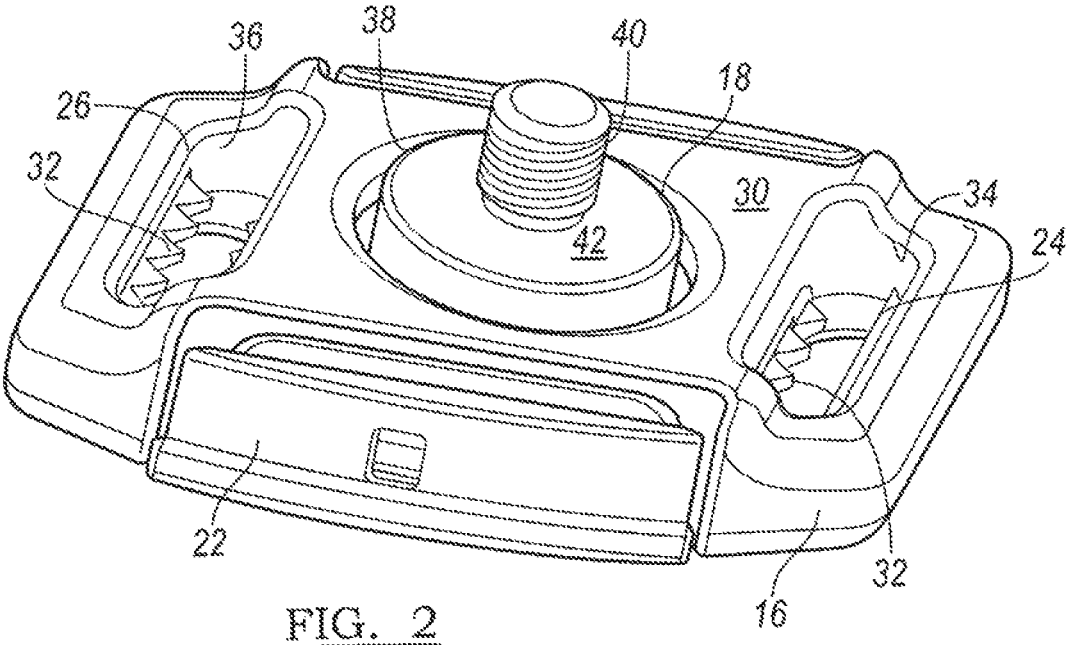
FIG. 2 is a perspective view of a bottom side of the strap latching device in accordance with the present invention.

Referring now to FIGS. 1 and 2 a strap latching device 10 is illustrated in accordance with the present invention. Strap latching device 10 is configured to releasably secure a strap or band 12 to a piece of sports or safety equipment 14 such as a football helmet, safety helmet or other protective device. An exemplary safety helmet is shown in U.S. Pat. No. 7,900,279, hereby incorporated by reference. The present invention contemplates other uses of the latching device, for example, releasably attaching or closing two members, such as buckling a coat or jacket.

Strap latching device 10 includes a locking buckle 16 and a clasp assembly 18. Locking buckle 16 has a main body member 20 generally rectangular in shape and includes a release mechanism 22. Main body portion 20 has a pair of rectangular slots 24 and 26 that extend transversely across a top surface 28 of the main body 20 and extend through to a bottom surface 30. Slots 24 and 26 include a plurality of retention teeth 32 disposed along interior walls 34 and 36, respectively, of slots 24, 26. The slots 24, 26 and teeth 32 are configured to retain a strap 12 on buckle 16 when the strap 12 is threaded through the slots 24, 26.

Figure 3:
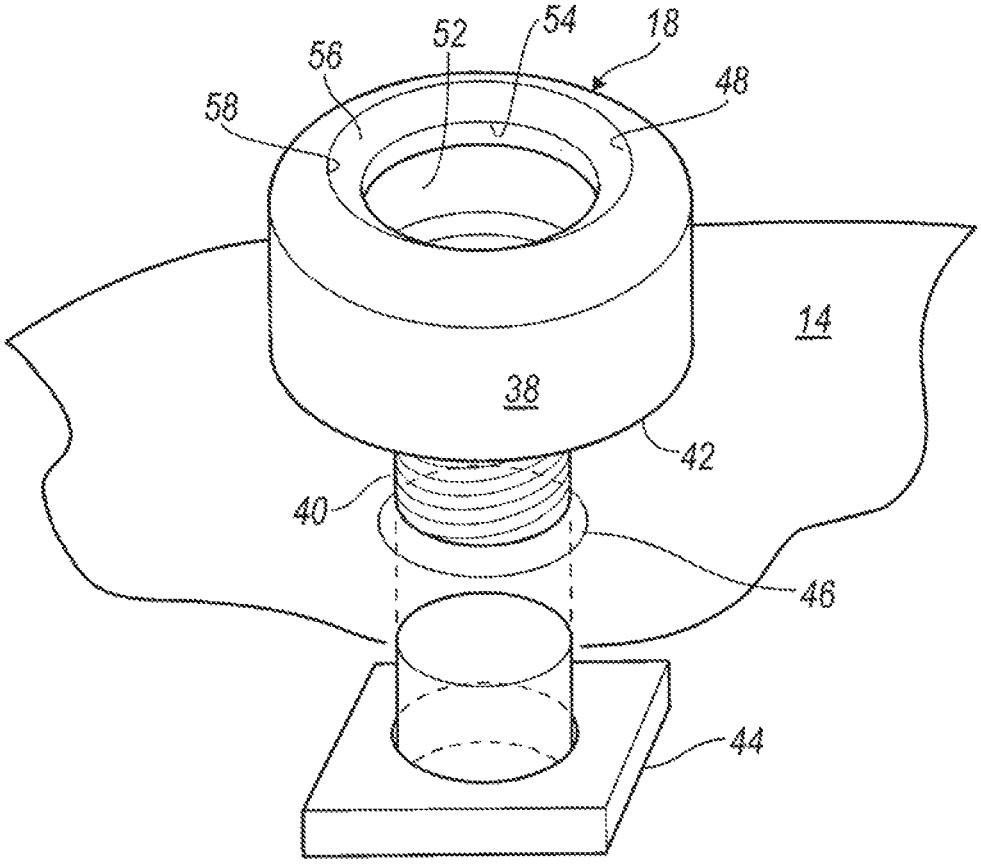
FIG. 3 is a perspective view of the clasp assembly of the strap latching device in accordance with the present invention.

Referring now to FIG. 3, clasp assembly 18 has a generally cylindrical receiving member 38 disposed on the end of a shaft 40. Shaft 40 extends from a base surface 42 of receiving member 38. In an embodiment of the present invention, shaft 40 is integrally formed on a bottom surface 42 of receiving member 38. Alternatively, shaft 40 is received in an aperture (not shown) disposed in the bottom surface 42 of receiving member 38. The clasp assembly 18 further includes a retention nut 44. The threaded shaft 40 is insertable through a clearance hole 46 in a helmet or other safety equipment and is fastened to the equipment through threaded engagement with a threaded bore in the retention nut 44.

Cylindrical receiving member 38 of clasp assembly 18 further includes a central bore 48 defined by an inner surface 52. Moreover, an annular rim 54 extends from the inner surface 52 that creates an inwardly extending lip or flange. A ramped, chamfered, or curved surface 56 is also provided and extends from an opening 58 of bore 48 to annular rim 54.

Figure 4:
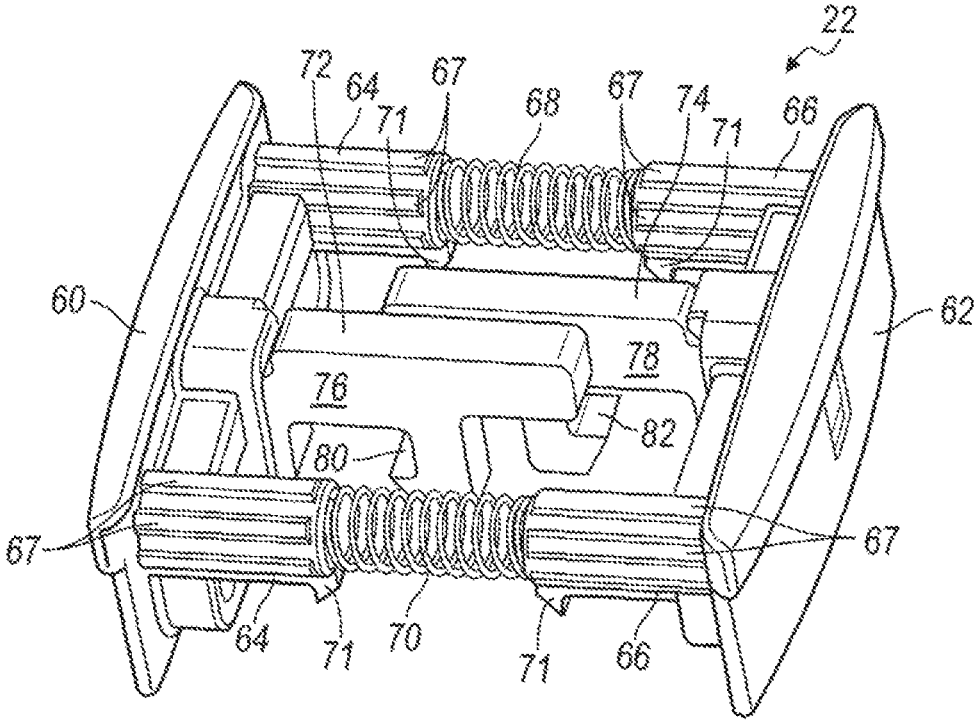
FIG. 4 is a perspective view of the release mechanism of the strap latching device in accordance with the present invention.

Referring now to FIG. 4, a perspective view of the release mechanism 22 is further illustrated, in accordance with the present invention. Release mechanism 22 includes a pair of opposing slider buttons 60 and 62. Slider buttons 60 and 62 each include a pair of opposing posts 64 and 66. Each of the opposing posts 64 and 66 have a plurality of radially displaced raised ridges 67. Each of the opposing posts 64 and 66 are held or biased apart by a pair of springs 68 and 70. Further, at the end of each of the posts there is disposed a locking claw 71. Each of the locking claws 71 have a ramped side and a flat surfaced side. Additionally, a pair of latching pawls 72 and 74 are disposed inwardly of opposing posts 64 and 66. Latching pawls 72 and 74 each have a generally rectangular bar member 76 and 78 and a claw member 80 and 82 extending from each of the rectangular bar members 76 and 78. Rectangular bar member 76 is attached to slider button 60 and rectangular bar member 78 is attached to slider button 62 by insert molding, gluing or other mechanical attachment. Latching pawls 72 and 74 are substantially identical in shape, made of a rigid durable material such as steel or metal alloy (preferably stainless steel) and are in an opposing and overlapping juxtaposition, as shown in FIG. 4.

Figure 5:
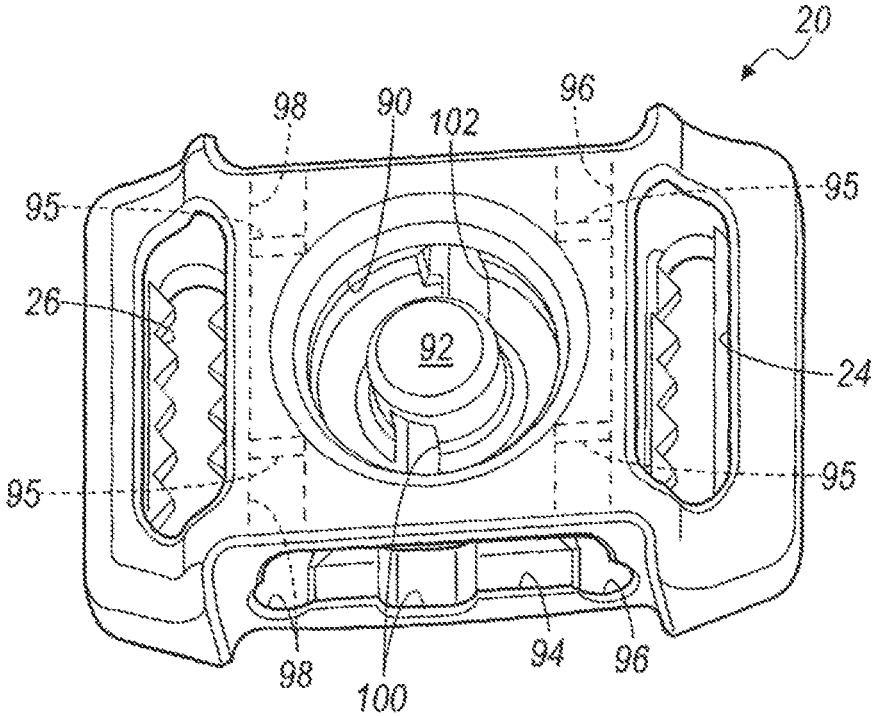
FIG. 5 is a bottom view of the main body portion of the locking buckle of the strap latching device in accordance with the present invention.

Referring now to FIG. 5, a bottom perspective view of the main body portion 20 of locking buckle 16 is illustrated without the release mechanism 22. Generally, centered in the main body portion 20 is a cylindrical recess 90. A center post 92 is centered in the cylindrical recess 90 and functions as a guide for receiving and centering the clasp assembly upon engagement of the clasp with the locking buckle 16. Thus, the center post facilitates both engagement and disengagement of the locking buckle 16 from the clasp assembly 18. On either side of main body portion 20 is a cavity 94. Cavity 94 receives slider buttons 60 and 62. More specifically, cavity 94 has a pair of through bores 96 and 98. Through bores 96, 98 extend through the main body portion 20 and are configured to receive the opposing posts 64 and 66 and springs 68 and 70. Through bores 96, 98 further include four raised ramps 95 for interaction with the locking claws 71. The locking claws 71 are configured with ramped sides to engage and slide past the raised ramps 95 and into bores 96, 98 through resilient deformation of the locking claws 71. The flat surfaced sides of locking claws 71 trap the locking claws 71 in cavity 94 through engagement with the raised ramps 95, thus, preventing slider buttons 60 and 62 from separating from the main body portion 20. Additionally, a pair of offset central bores 100 and 102 are further provided in cavity 94 and extend into center post 92. Offset central bores 100 and 102 slidably receive latching pawls 72 and 74.

Figure 6:
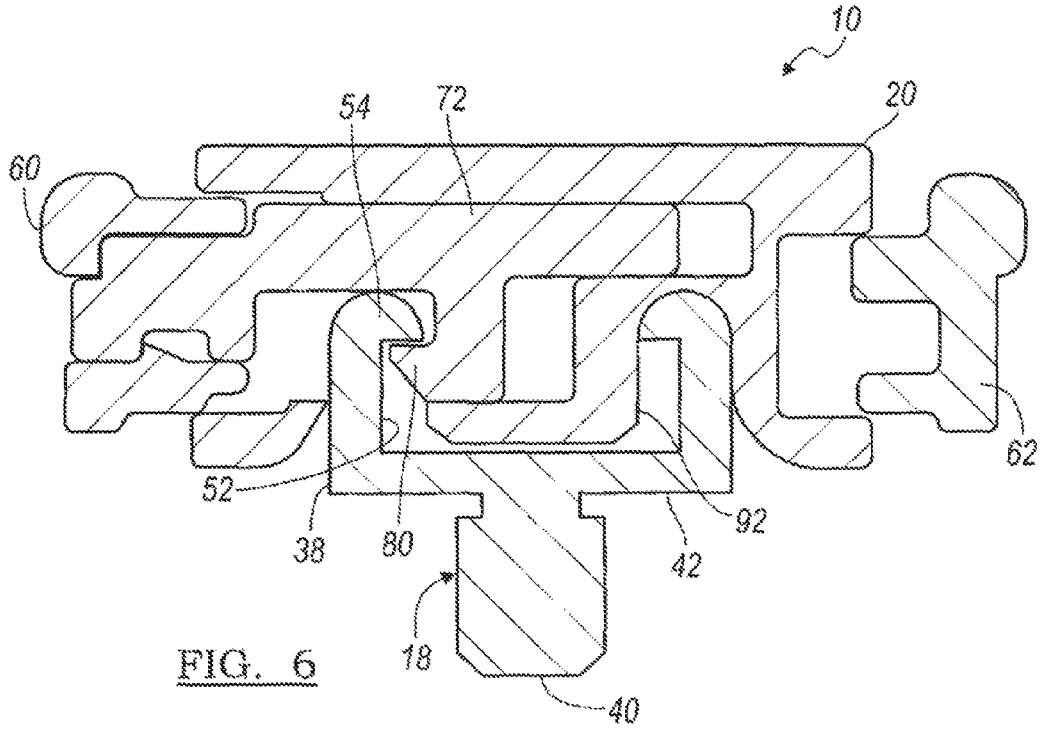
FIG. 6 is a cross-sectional view of the strap latching device in the releasably attached position, in accordance with the present invention.
Figure 7:
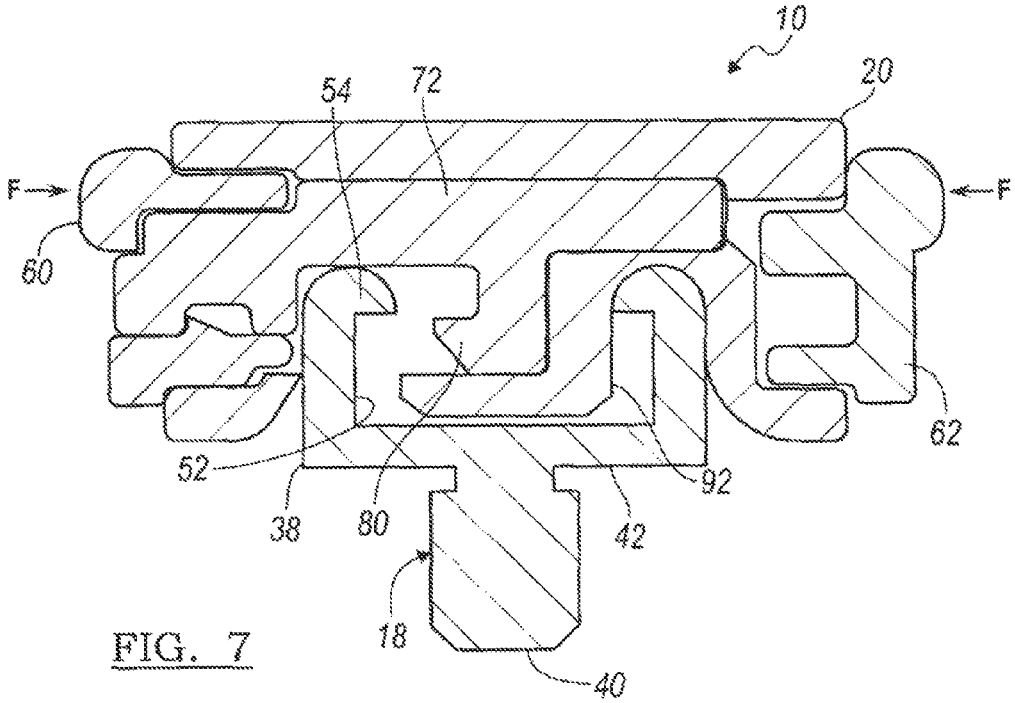
FIG. 7 is a cross-sectional view of the strap latching device in the released position, in accordance with the present invention.

With specific reference to FIGS. 6 and 7, cross-sectional views of strap latching device 10 are illustrated. More specifically, FIG. 6. illustrates how the latching pawl 72 and claw member 80 interacts with the annular rim 54 of the cylindrical receiving member 38 of clasp assembly 18 when the locking buckle 16 is releasably attached to the clasp assembly 18. In the releasably attached position, the locking buckle 16 is prevented from be pulled apart from clasp assembly 18 by the engagement of the claw member 80 with the annular rim 54. The springs 68 and 70 provide a biasing force urging the claw member 80 toward the inner surface 52 and under the annular rim 54. When a force is applied to the slider buttons 60 and 62 the claw members 80 and 82 are retracted from the annular rim 54, thus, allowing the locking buckle 16 to be disengaged and released from the clasp assembly 18. Latching pawl 74 and claw member 82 interact with rim 54 and function in substantially the same way as described above with respect to latching pawl 72 and claw member 80.

FIG. 7. illustrates how the latching pawl 72 and claw member 80 is disengaged from the annular rim 54 of the cylindrical receiving member 38 of clasp assembly 18 when a releasing force "F" is applied to the slider buttons 60 and 62 of release mechanism 22. In the released position, the locking buckle 16 is disengaged and released from the clasp assembly 18 by the retraction of the claw member 80 away from and clearing the annular rim 54. The claw member 80 retracts into the center post 92 preventing interference with the annular rim 54, thus, facilitating disengagement of the locking buckle 16 with the clasp assembly 18. When a force is applied to the slider buttons 60 and 62 the claw members 80 and 82 are retracted from the annular rim 54 allowing the locking buckle 16 to be disengaged and released from the clasp assembly 18, as shown in FIG. 7.

Figure 8:
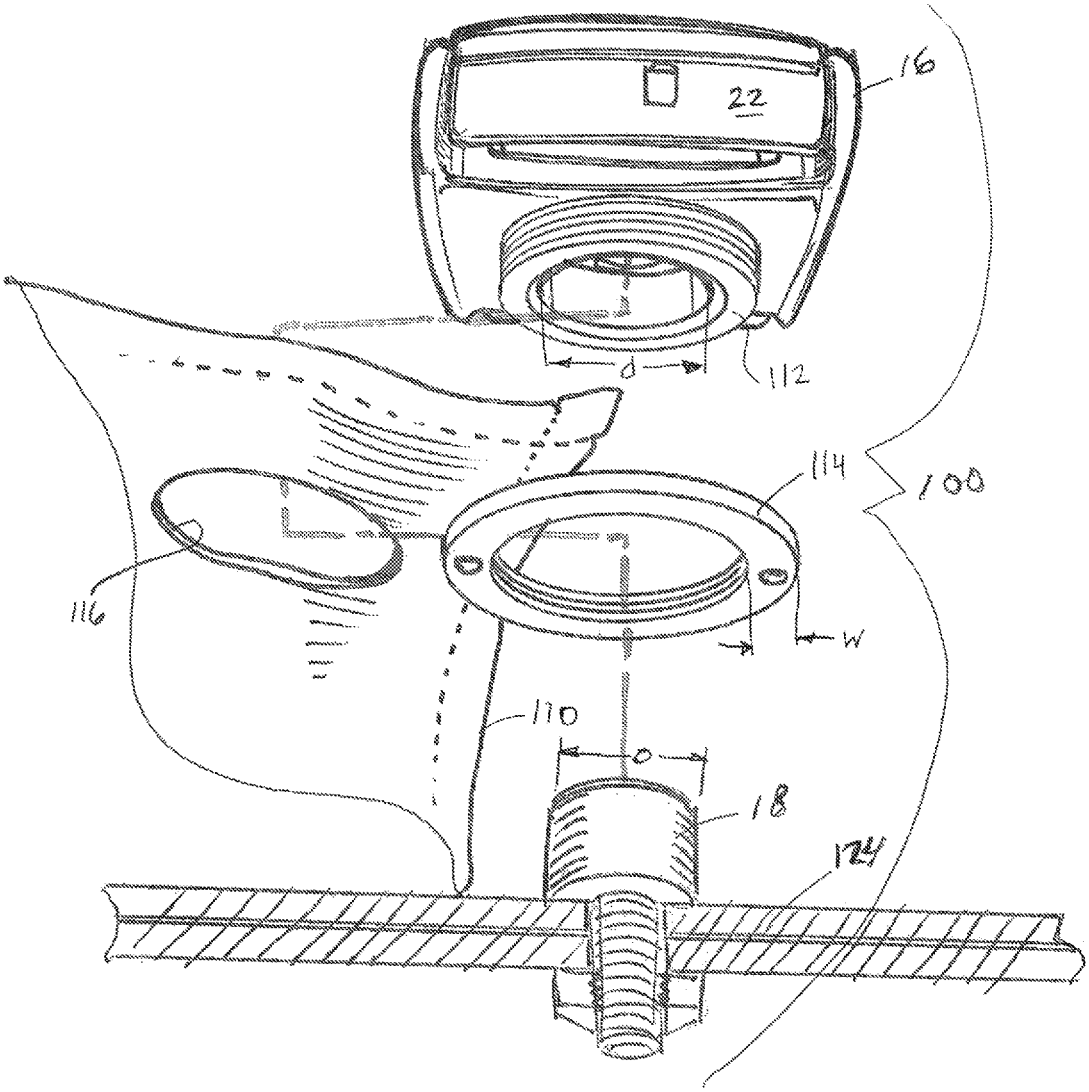
FIG. 8 is a perspective view of another embodiment of the strap latching device of the present invention configured to secure a piece of material to another member.

Referring now to FIG. 8, a perspective view of another embodiment of the latching device of the present invention is illustrated and generally referenced as 100. Latching device 100 is configured as described above with respect to strap latching device 10, however, latching device 100 has been reconfigured to secure a first piece of material 110 to a second piece of member 124. For example, the first piece of material is a boat tarp and the second piece of material is a boat hull. Latching device 100 includes locking buckle 16 releasably secured to clasp assembly 18. Locking buckle 16 and clasp assembly 18 are configured and releasably cooperate as described above. However, locking buckle 16 of the present embodiment does not include a pair of rectangular slots 24 and 26 that extend transversely across a top surface 28 of the main body 20 and extend through to a bottom surface 30 as previously described with respect to the embodiments described above. Alternatively, the locking buckle 16 of the present embodiment further includes a threaded shaft 112 having a threaded outside surface and having an inner aperture having an inside surface having a diameter "d" sized such that threaded shaft 112 fits over the outer diameter "o" of the clasp assembly 18. Moreover, threaded shaft 112 is configured to engage with a threaded annular ring 114 having a threaded inner surface. Threaded annular ring 114 has a width "w" that may be varied depending on the application and the type of material to be secured to the locking buckle 16. The clasp assembly 18 is secured to another member 124, which may be a hard or soft surface through an appropriate mechanical means, such as a threaded shaft and nut or riveting or the like. In operation, material 110 is provided with an aperture 116 that is large enough to fit over threaded shaft 112. Annular ring 114 is turned onto threaded shaft 112 "sandwiching" or securing the material 110 between the locking buckle 16 and the annular ring 114. Of course, other methods for securing the material 110 to locking buckle 16 are contemplated by the present invention, for example, the material 110 may be mechanically secured to locking buckle 16 through crimping or the like or through the use of an adhesive.

The present invention has many advantages over the prior art, for example, the latching device 10 may be configured to releasably attach two members together. The members may be of two different or like materials, i.e. cloth, plastic, metal, flexible or rigid materials or the like. For example, the latching device 10 of the present invention may be used to secure a boat tarp to a boat or other marine equipment. Other industries the latching device 10 of the present invention will find applicability are military, medical, automotive, home garden and clothing, for example.

The description of the invention is merely exemplary in nature and variations that do not depart from the gist of the invention are intended to be within the scope of the invention. Such variations are not to be regarded as a departure from the spirit and scope of the invention.

The invention claimed is:

1. A latching device for releasably securing a first member to a second member, the latching device comprising: a main body member having a central cavity and a side cavity and having a first attachment member attached at an end to a bottom surface of the main body; a second attachment member engagable with the first attachment member to secure the first member to the main body; a release mechanism having a pair of opposing buttons, a pair of locking pawls and a first biasing member, wherein one of the pair of locking pawls is fixedly attached to one of the pair of opposing buttons and the other of the pair of locking pawls is fixedly attached to the other of the pair of opposing buttons, wherein the pair of locking pawls extend through the side cavity of the main body member and extend into the central cavity of the main body member and wherein the first biasing member is disposed between the opposing buttons urging the buttons away from each other; and a clasp attachable to the second member, the clasp having a cylindrical body sized for receipt within the central cavity of the main body member and having a central cavity defined by an inner surface, wherein an annular rim extends inward from the inner surface of the central cavity of the cylindrical body, and wherein the locking pawls are configured to engage the annular rim of the central cavity of the clasp.

2. The latching device of claim 1, wherein the side cavity of the main body portion further includes a pair of offset bores for receiving the locking pawls.

3. The latching device of claim 1, wherein the main body portion further includes a central post sized to be receivable within the central cavity of the cylindrical body of the clasp.

4. The latching device of claim 3, wherein the central post further includes a pair of offset bores for receiving the locking pawls.

5. The latching device of claim 1, wherein each of the pair of opposing buttons further comprise a pair of opposing posts sized for slidable disposition within the side cavity of the main body portion.

6. The latching device of claim 5, wherein the pair of opposing posts each have a locking claw for engaging the main body member and retaining the opposing buttons within the side cavity of the main body member.

7. The latching device of claim 6, further comprising a second biasing member, wherein the first and the second biasing members are each disposed between each of the pair of opposing posts.

8. The latching device of claim 1, wherein each of the pair of slots of the main body member have a plurality of teeth for engaging the strap.

9. The latching device of claim 1, wherein each of the pair of locking pawls further comprise a claw member for engaging the annular rim of the central cavity of the cylindrical body.

10. The latching device of claim 1, wherein the clasp further comprises a threaded shaft attached to a bottom surface of the clasp and a threaded nut for securing the clasp to a piece of sports equipment.

11. The latching device of claim 1, wherein the first attachment member is a threaded shaft attached at an end to the bottom surface of the main body.

12. The latching device of claim 11, wherein the second attachment member is an annular ring having a threaded inner surface that engages with the threaded shaft attached at an end to the bottom surface of the main body.

* * * * *